United States Patent [19]

Silvestri, Jr.

[11] 4,274,259

[45] Jun. 23, 1981

[54] SUPERHEATED STEAM POWER PLANT WITH STEAM TO STEAM REHEATER

[75] Inventor: George J. Silvestri, Jr., Upper Chichester, Pa.

[73] Assignee: Westinghouse Electric Corp., Pittsburgh, Pa.

[21] Appl. No.: 882,831

[22] Filed: Mar. 2, 1978

Related U.S. Application Data

[63] Continuation-in-part of Ser. No. 728,475, Sep. 30, 1976, abandoned.

[51] Int. Cl.[2] ..... F01K 7/22

[52] U.S. Cl. ..... 60/663; 60/653; 60/680

[58] Field of Search ..... 60/653, 663, 679, 680

[56] References Cited

U.S. PATENT DOCUMENTS

| | | | |
|---|---|---|---|
| 2,747,373 | 5/1956 | Eggenberger et al. | 60/663 X |
| 2,902,831 | 9/1959 | Ipsen et al. | 60/663 X |
| 3,169,374 | 2/1965 | Powell et al. | 60/653 X |
| 3,898,842 | 8/1975 | Luongo | 60/663 X |
| 3,979,914 | 9/1976 | Weber | 60/653 X |

*Primary Examiner*—Allen M. Ostrager
*Assistant Examiner*—Stephen F. Husar
*Attorney, Agent, or Firm*—F. J. Baehr, Jr.

[57] ABSTRACT

A desuperheater is disposed in a steam supply line supplying superheated steam to a shell and tube reheater.

2 Claims, 2 Drawing Figures

SUPERHEATED STEAM POWER PLANT WITH STEAM TO STEAM REHEATER

CROSS-REFERENCE TO RELATED APPLICATION

This is a continuation in-part of application Ser. No. 728,475 filed Sept. 30, 1976, now abandoned.

BACKGROUND OF THE INVENTION

This invention relates to shell and tube reheaters and more particularly to such reheaters utilizing superheated steam as the heating medium.

Shell and tube reheaters which are subjected to large cycling temperature changes have experienced a large number of tube failures. The proposed liquid metal fast breeder reactor and other high temperature reactor power plants will increase the potential of cyclic variations in tube temperature as the proposed steam cycles will utilize superheated steam from either the main steam supply or superheated extraction steam as the heating medium in the reheaters. While superheated steam will improve the heat rate, the high temperature steam is expected to sufficiently increase the potential of the tube failure and unscheduled outages.

SUMMARY OF THE INVENTION

In general a power plant, when made in accordance with this invention, comprises in combinaton a supply of superheated steam, a first turbine receiving superheated steam and exhausting steam at a lower pressure, a second turbine receiving exhaust steam from the first turbine and a reheater disposed between the first and second turbine to reheat the steam flowing therebetween. This invention further comprises utilizing superheated steam as a heating medium in the reheater and a desuperheater disposed to desuperheat steam before it enters the reheater, whereby the reheater may be operated with a low temperature gradient thereby reducing thermal shock on the tubes and extending the life of the reheater.

BRIEF DESCRIPTION OF THE DRAWINGS

The objects and advantages of this invention will become more apparent from reading the following detailed description in connection with the accompanying drawings, in which corresponding reference numerals indicate corresponding portions throughout the drawings and in which.

DESCRIPTION OF THE PREFERRED EMBODIMENT

Figure 1:
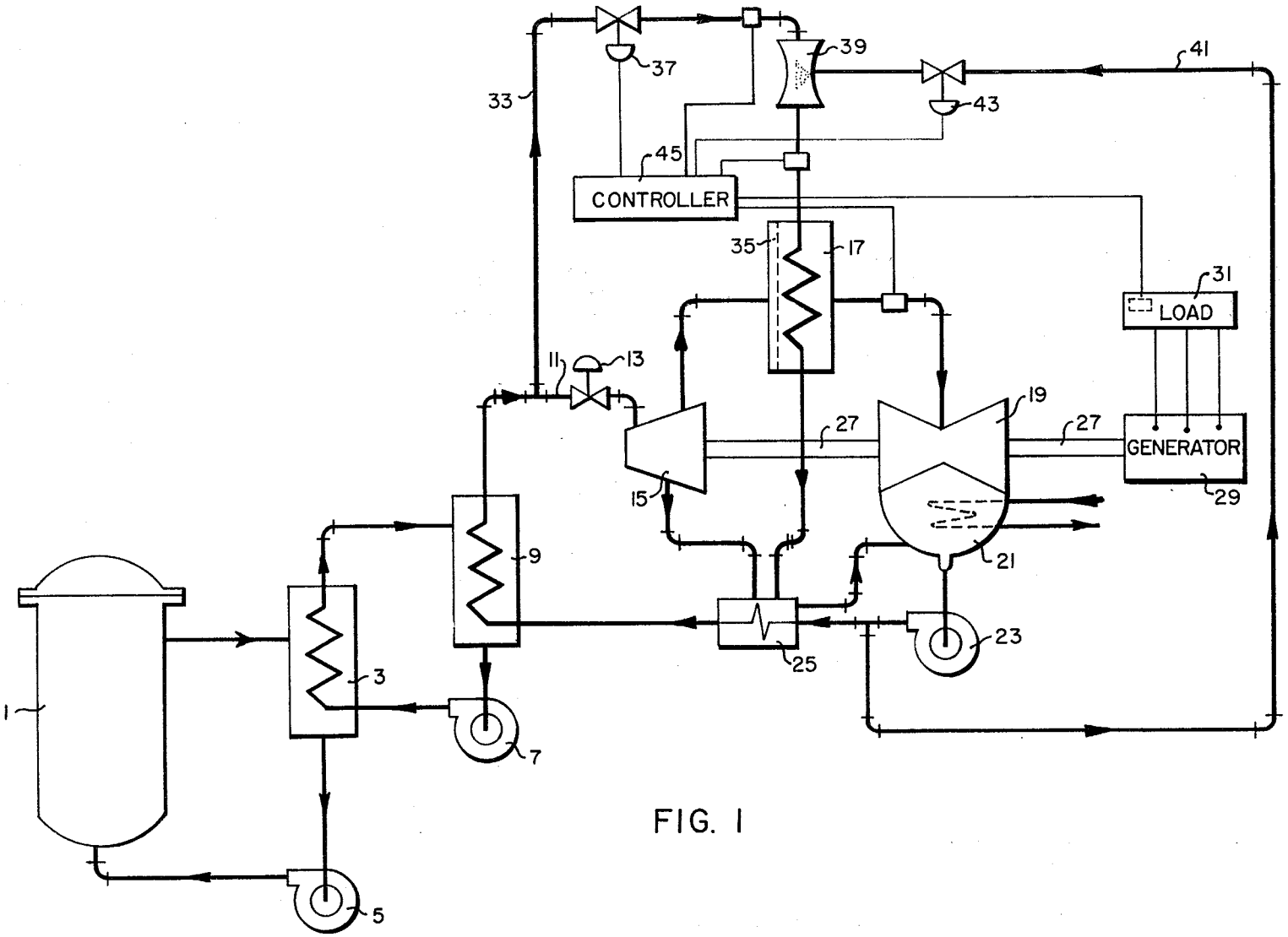
FIG. 1 is a flow diagram of a power plant incorporating this invention.

Referring now to the drawings in detail and in particular to FIG. 1 there is shown a simplified flow diagram for a liquid metal fast breeder reactor power plant in which a reactor 1 is cooled by primary sodium or other suitable liquid metals circulated through the reactor 1 and through an intermediate heat exchanger 3 by a circulating pump 5. The neutron flux in the reactor is sufficiently high that the sodium and some of the impurities entrained therein becomes radioactive and in order to prevent a reaction between radioactive sodium and water or steam an intermediate heat exchange loop is utilized. In the intermediate heat exchange loop a circulating pump 7 circulates intermediate liquid sodium in a closed loop through the intermediate heat exchanger 3 and through a steam generator 9 which produces superheated steam.

The superheated steam from the steam generator 9 flows through a main steam conduit or line 11 and a control valve 13 to a first or high pressure turbine 15. The exhaust from the high pressure turbine 15 flows through the shell portion of a shell and tube moisture separator reheater 17 and into a second or low pressure turbine 19. The exhaust from the low pressure turbine 19 flows to a condenser 21, where it is condensed by circulating or cooling water supplied thereto in a heat transfer relationship with the exhaust steam. The condensate formed is picked up by a pump 23, passes through a feedwater heater 25 and return to the steam generator forming a closed cycle. The turbines 15 and 19 are disposed on a common shaft 27 and change the heat and pressure energy in the steam to rotating mechanical energy. Also connected to the shaft 27 is a generator 29 which converts the rotating mechanical energy to electrical energy which supplies power to some load 31.

The portion of the flow diagram hereinbefore described, as is obvious to those of ordinary skill in the art, has been simplified so that it provides a general background for the invention which comprises a conduit or pipe 33 connecting the main steam line 11 to the reheater 17. The reheater 17 is a shell and tube moisture separator reheater in which steam from the turbine 15 enters the shell portion, flows through a moisture separator 35 and then over the tubes picking up heat from the heating medium flowing through the tubes and then the reheated steam from the reheater 17 flows to the low pressure turbine 19. Superheated steam supplied via the conduit 33 passes through a throttle valve 37 and a desuperheater 39 prior to entering the tubes of the reheater 17, which are disposed in a heat transfer relationship with the steam flowing between the turbines 15 and 19. Feedwater is supplied to the desuperheater 39 via the conduit 41 and a control valve 43 is disposed in the conduit 41 to control the flow of feedwater to the desuperheater 39. A controller 45 responsive to the pressure of the steam entering the desuperheater, the temperature of the steam leaving the desuperheater, the temperature of the steam flowing to the low pressure turbine 19 and the load to control the throttle valve 37 in the steam supply conduit 33 and the feedwater control valve 43 in such a manner that the temperature of the steam entering the reheater is saturated steam or has only a very small amount of superheat in order to minimize cyclic temperature variations within the reheater and reduce the number of tube failures due to thermal shock.

Figure 2:
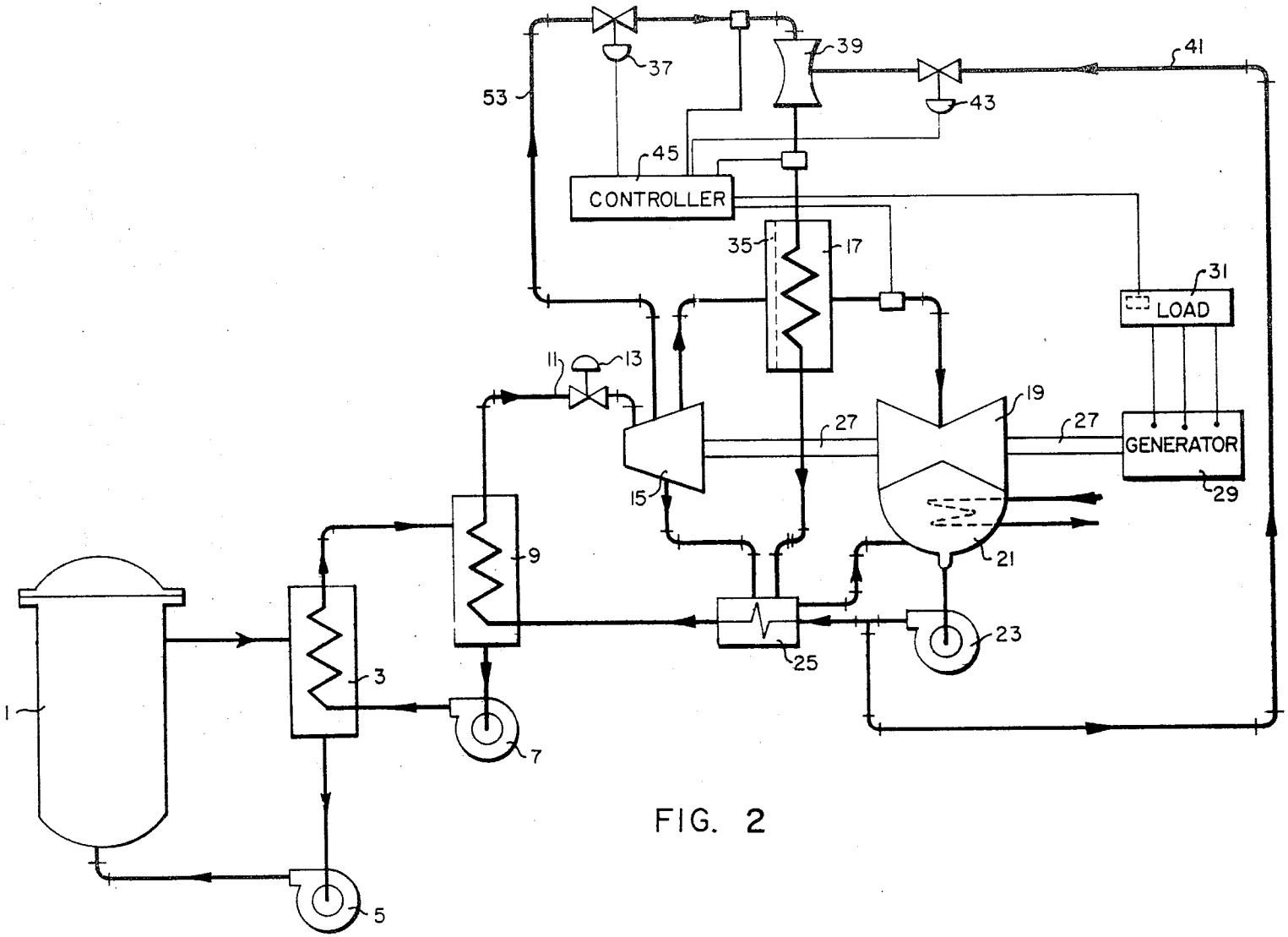
FIG. 2 is an alternate flow diagram of a power plant incorporating this invention.

The flow diagram shown in FIG. 2 is generally the same on the one shown in FIG. 2 with the exception of the steam supply to the reheater 17 is supplied via a steam supply line 53 which extracts steam from a high pressure stage of the high pressure turbine 15 rather than being connected to the main steam line 11.

The operation of the system is as follows:

The station operator or plant controller 45 selects the desired temperature, TD, of the steam leaving the reheater 17 (shell side of reheater). This shell side steam goes to the low pressure turbine 19. The reheater 17 is designed so that the shell side steam temperature approaches the condensing (saturation) temperature of the steam supply to the reheater 17 within a given amount, ΔT. The condensing or saturation temperature, TS, of steam is a function of its pressure or conversely the saturation pressure is a function of the temperature. TS is the sum of TD and ΔT. So the pressure downstream of the valve 37 would be a function of TS (P39=f(TS)). This desired pressure would be compared to the pressure in the line between the desuperheater 39 and reheater 17 and the deviation would activate valve 37.

The maximum superheat, SHT, in the steam supply to the reheater 17 would also be selected by the operator (a set point) or the controller 45. The maximum temperature leaving the desuperheater 39, Tmax, would be the sum of TS and the maximum superheat, (Tmax=TS+SHT). If the temperature sensor in the line between the desuperheater 39 and the reheater 17 detects a temperature, T line, higher than Tmax, valve 43 would open and would continue to do so until T line equals Tmax. If Tmax is less than T line, valve 43 would close.

The foregoing discussion pertains to start-up and low load operation.

During normal operation valve 37 is wide open. So TS would be a function of the pressure in line 53 or 33 (saturation pressure—saturation temperature relationship). Once again Tmax would equal the sum of TS and SHT. Valve 43 would control the temperature as stated hereinbefore.

Besides utilizing temperature and pressure signals, the controller 45 also utilizes a signal from the load. This signal from the load is an anticipatory signal, that is, it is an early signal which helps the controller anticipate changes in temperature and pressure, which normally result from changes in load, long before the system's temperature and pressure change. Thus, the control system begins to respond before the pressure and temperature signals indicate a change has occurred.

While the systems shown in FIGS. 1 and 2 represent a liquid metal fast breeder reactor system this invention is applicable to any reactor system that supplies high temperature steam such as high temperature gas cooled reactors, high temperature reactors, advanced gas reactors and gas cooled fast reactor systems.

The invention also allows the use of the reheater during periods of low load as by throttling and desuperheating, the steam leaving the desuperheater may be controlled at any temperature making it unnecessary to wait until the load has reached some predetermined value so that the thermal gradient within the reheater will be within its operating range as has been common practice with reheaters without desuperheaters.

What is claimed is:

1. A power plant comprising in combination means for supplying superheated steam, a first turbine receiving said superheating steam and exhausting steam at a lower pressure and temperature, a second turbine receiving exhaust steam from said first turbine, said turbines being connected to a load, a reheater disposed between said first and second turbine to reheat the steam flowing from said first to said second turbine, said reheater utilizing superheated steam from within said power plant as the heating medium, a desuperheater disposed to desuperheat the superheated steam from within said power plant before it enters said reheater, a controller responsive to the pressure of said steam entering said desuperheater, the temperature of the steam leaving said desuperheater, the temperature of the steam entering said second turbine and said load to control said desuperheater and throttling means disposed to throttle the steam from within the power plant before it enters the desuperheater, said controller also controlling said throttling means, whereby the reheater may be operated with low temperature gradients reducing thermal shock and extending the life of the reheater.

2. The combination as set forth in claim 1, wherein the reheater is a shell and tube reheater and the steam from within the power plant passes through the tubes.

* * * * *